US007270573B2

(12) United States Patent
Houtz

(10) Patent No.: US 7,270,573 B2
(45) Date of Patent: Sep. 18, 2007

(54) ELECTRICAL CONNECTOR WITH LOAD BEARING FEATURES

(75) Inventor: Timothy W. Houtz, Etters, PA (US)

(73) Assignee: FCI Americas Technology, Inc., Reno, NV (US)

( * ) Notice: Subject to any disclaimer, the term of this patent is extended or adjusted under 35 U.S.C. 154(b) by 3 days.

(21) Appl. No.: 11/141,423

(22) Filed: May 31, 2005

(65) Prior Publication Data

US 2005/0266728 A1 Dec. 1, 2005

Related U.S. Application Data

(63) Continuation-in-part of application No. 10/232,883, filed on Aug. 30, 2002, now Pat. No. 6,899,548.

(51) Int. Cl.
*H01R 13/648* (2006.01)

(52) U.S. Cl. ..... 439/608; 439/609; 439/71

(58) Field of Classification Search ..... 439/71, 439/79, 590, 608–609, 701, 856–857, 937, 439/263, 268

See application file for complete search history.

(56) References Cited

U.S. PATENT DOCUMENTS

| | | | | |
|---|---|---|---|---|
| 3,115,379 | A | 12/1963 | McKee | 339/47 |
| 3,286,220 | A | 11/1966 | Marley et al. | 439/680 |
| 3,538,486 | A | 11/1970 | Shlesinger, Jr. | 439/268 |
| 3,609,633 | A * | 9/1971 | Hargett | 439/62 |
| 3,669,054 | A | 6/1972 | Desso et al. | 113/119 |
| 3,704,441 | A | 11/1972 | Douglass | 339/220 |
| 3,725,853 | A | 4/1973 | McKeown et al. | 339/252 |
| 3,731,252 | A | 5/1973 | McKeown et al. | 339/17 |
| 3,748,633 | A | 7/1973 | Lundergan | 339/217 S |
| 4,076,362 | A | 2/1978 | Ichimura | 339/75 |
| 4,140,361 | A * | 2/1979 | Sochor | 439/682 |
| 4,159,861 | A | 7/1979 | Anhalt | 339/75 |
| 4,260,212 | A | 4/1981 | Ritchie et al. | 339/97 R |
| 4,288,139 | A | 9/1981 | Cobaugh et al. | 339/74 R |
| 4,383,724 | A | 5/1983 | Verhoevan | 439/510 |
| 4,402,563 | A | 9/1983 | Sinclair | 339/75 |
| 4,480,888 | A | 11/1984 | Hopkins et al. | 339/74 |
| 4,560,222 | A | 12/1985 | Dambach | 339/75 |

(Continued)

FOREIGN PATENT DOCUMENTS

EP 0 273 683 A2 7/1988

(Continued)

*Primary Examiner*—Michael C. Zarroli
(74) *Attorney, Agent, or Firm*—Woodcock Washburn LLP

(57) ABSTRACT

Complementary contact and contact block designs are disclosed that help prevent movement of a contact received in the contact block when an electrical connector is press-fit or otherwise connected to a printed circuit board. A protrusion may be included on one or both beams of a dual beam contact, and a contact cavity may be formed in the contact block. The protrusion and the contact cavity may include complementary shapes such that the protrusion abuts a wall within the contact cavity, preventing the contact from moving relative to the contact block as the electrical connector is connected to a printed circuit board. The protrusion and a wall of the contact cavity additionally may include other complementary shapes (e.g., a radius or angle shape) such that a length of the protrusion abuts the contact cavity wall, providing a longer load bearing surface.

38 Claims, 15 Drawing Sheets

U.S. PATENT DOCUMENTS

| | | | | |
|---|---|---|---|---|
| 4,607,907 | A | 8/1986 | Bogursky | 339/258 |
| 4,684,193 | A | 8/1987 | Havel | 439/259 |
| 4,717,360 | A | 1/1988 | Czaja | 439/710 |
| 4,728,164 | A | 3/1988 | Lemmens et al. | 439/870 |
| 4,776,803 | A | 10/1988 | Pretchel et al. | 439/59 |
| 4,815,987 | A | 3/1989 | Kawano et al. | 439/263 |
| 4,867,713 | A | 9/1989 | Ozu et al. | 439/833 |
| 4,878,861 | A | 11/1989 | Kendall et al. | 439/751 |
| 4,907,990 | A | 3/1990 | Bertho et al. | 439/851 |
| 4,936,797 | A | 6/1990 | Wehrle et al. | 439/751 |
| 4,964,814 | A | 10/1990 | Tengler et al. | 439/607 |
| 4,973,271 | A | 11/1990 | Ishizuka et al. | 439/839 |
| 5,066,236 | A | 11/1991 | Broeksteeg | 439/79 |
| 5,077,893 | A | 1/1992 | Mosquera et al. | 29/882 |
| 5,174,770 | A | 12/1992 | Sasaki et al. | 439/108 |
| 5,238,414 | A | 8/1993 | Yaegashi et al. | 439/108 |
| 5,254,012 | A | 10/1993 | Wang | 439/263 |
| 5,274,918 | A | 1/1994 | Reed | 29/882 |
| 5,302,135 | A | 4/1994 | Lee | 439/263 |
| 5,403,215 | A | 4/1995 | Buchter et al. | 439/869 |
| 5,431,578 | A | 7/1995 | Wayne | 439/259 |
| 5,475,922 | A | 12/1995 | Tamura et al. | 29/881 |
| 5,487,684 | A | 1/1996 | Schalk et al. | 439/715 |
| 5,558,542 | A | 9/1996 | O'Sullivan et al. | 439/682 |
| 5,564,954 | A | 10/1996 | Wurster | 439/751 |
| 5,573,431 | A | 11/1996 | Wurster | 439/751 |
| 5,588,859 | A | 12/1996 | Maurice | 439/290 |
| 5,590,463 | A | 1/1997 | Feldman et al. | 29/844 |
| 5,609,502 | A | 3/1997 | Thumma | 439/747 |
| 5,645,436 | A | 7/1997 | Shimizu et al. | 439/108 |
| 5,676,570 | A | 10/1997 | Scherer | 439/787 |
| 5,697,818 | A | 12/1997 | Fukuda | 439/751 |
| 5,730,609 | A | 3/1998 | Harwath | 439/108 |
| 5,741,144 | A | 4/1998 | Elco et al. | 439/101 |
| 5,741,161 | A | 4/1998 | Cahaly et al. | 439/709 |
| 5,761,050 | A | 6/1998 | Archer | 361/791 |
| 5,795,191 | A | 8/1998 | Preputnick et al. | 439/608 |
| 5,817,973 | A | 10/1998 | Elco et al. | 174/32 |
| 5,908,333 | A | 6/1999 | Perino et al. | 439/631 |
| 5,961,355 | A | 10/1999 | Morlion et al. | 439/686 |
| 5,971,817 | A | 10/1999 | Loungeville | 439/857 |
| 5,980,271 | A | 11/1999 | MacDougall et al. | 439/78 |
| 5,980,321 | A | 11/1999 | Cohen et al. | 439/608 |
| 5,993,259 | A | 11/1999 | Stokoe et al. | 439/608 |
| 6,042,389 | A | 3/2000 | Lemke et al. | 439/74 |
| 6,050,862 | A | 4/2000 | Ishii | 439/843 |
| 6,068,520 | A | 5/2000 | Winings et al. | 439/676 |
| 6,123,554 | A | 9/2000 | Ortega et al. | 439/79 |
| 6,125,535 | A | 10/2000 | Chiou et al. | 29/883 |
| 6,139,336 | A | 10/2000 | Olson | 439/83 |
| 6,146,157 | A | 11/2000 | Lenoir et al. | 439/101 |
| 6,146,203 | A | 11/2000 | Elco et al. | 439/609 |
| 6,190,213 | B1 | 2/2001 | Reichart et al. | 439/736 |
| 6,212,755 | B1 | 4/2001 | Shimada et al. | 29/527.1 |
| 6,219,913 | B1 | 4/2001 | Uchiyama | 29/883 |
| 6,220,896 | B1 | 4/2001 | Bertoncici et al. | 439/608 |
| 6,269,539 | B1 | 8/2001 | Takahashi et al. | 29/883 |
| 6,293,827 | B1 | 9/2001 | Stokoe et al. | 439/608 |
| 6,319,075 | B1 | 11/2001 | Clark et al. | 439/825 |
| 6,325,643 | B1 | 12/2001 | Ohtsuki et al. | 439/82 |
| 6,328,602 | B1 | 12/2001 | Yamasaki et al. | 439/608 |
| 6,347,952 | B1 | 2/2002 | Hasegawa et al. | 439/608 |
| 6,350,134 | B1 | 2/2002 | Fogg et al. | 439/79 |
| 6,363,607 | B1 | 4/2002 | Chen et al. | 29/883 |
| 6,371,773 | B1 | 4/2002 | Crofoot et al. | 439/79 |
| 6,379,188 | B1 | 4/2002 | Cohen et al. | 439/608 |
| 6,386,914 | B1 | 5/2002 | Collins et al. | 439/579 |
| 6,409,543 | B1 | 6/2002 | Astbury, Jr. et al. | 439/608 |
| 6,431,914 | B1 | 8/2002 | Billman | 439/608 |
| 6,435,914 | B1 | 8/2002 | Billman | 439/608 |
| 6,454,575 | B1 | 9/2002 | Jones et al. | 439/79 |
| 6,454,615 | B1 | 9/2002 | Yu | 439/752.5 |
| 6,461,202 | B2 | 10/2002 | Kline | 439/701 |
| 6,471,548 | B2 | 10/2002 | Bertoncini et al. | 439/608 |
| 6,506,081 | B2 | 1/2003 | Blanchfield et al. | 439/682 |
| 6,537,111 | B2 | 3/2003 | Brammer et al. | 439/857 |
| 6,554,647 | B1 | 4/2003 | Cohen et al. | 439/607 |
| 6,572,410 | B1 | 6/2003 | Volstorf et al. | 439/608 |
| 6,652,318 | B1 | 11/2003 | Winnings et al. | 439/608 |
| 6,692,272 | B2 | 2/2004 | Lemke et al. | 439/108 |
| 2001/0010979 | A1 | 8/2001 | Ortega et al. | 439/79 |
| 2003/0143894 | A1 | 7/2003 | Kline | 439/608 |
| 2003/0220021 | A1 | 11/2003 | Whiteman, Jr. et al. | 439/608 |

FOREIGN PATENT DOCUMENTS

| | | |
|---|---|---|
| JP | 06-236788 | 8/1994 |
| JP | 07-114958 | 5/1995 |
| JP | 2000/003743 | 1/2000 |
| JP | 2000/003744 | 1/2000 |
| JP | 2000-003745 | 1/2000 |
| JP | 2000-003746 | 1/2000 |
| WO | WO 01/29931 A1 | 4/2001 |
| WO | WO 01/39332 A1 | 5/2001 |

* cited by examiner

ELECTRICAL CONNECTOR WITH LOAD BEARING FEATURES

CROSS REFERENCE TO RELATED APPLICATIONS

The present application is a continuation-in-part of U.S. patent application having Ser. No. 10/232,883 filed Aug. 30, 2002 now U.S. Pat. No. 6,899,548, entitled "Electrical Connector Having A Cored Contact Assembly," which is assigned to the assignee of the present application and hereby incorporated herein by reference in its entirety.

The present application is related to U.S. patent application having Ser. No. 10/232,353 filed Aug. 30, 2002, entitled "Connector Receptacle Having A Short Beam And Long Wipe Dual Beam Contact," which is assigned to the assignee of the present application and hereby incorporated herein by reference in its entirety.

FIELD OF THE INVENTION

The invention relates to electrical connectors and specifically to electrical connectors in which electrical contacts are inserted into the connector or a contact block of the connector during connector assembly.

BACKGROUND OF THE INVENTION

Electrical connectors may be connected to substrates such as printed circuit boards. A type of electrical connector may include insert molded lead assemblies, where contacts are molded as part of and thus encapsulated within contact blocks. A second type of electrical connector may include a contact block into which electrical contacts are inserted after the contact block is manufactured.

One method of connecting an electrical connector to a printed circuit board is by a press-fit engagement with the board. The connector may be pressed down on the printed circuit board with a force large enough to fully connect contacts of the electrical connector with the printed circuit board. For those connectors that include contacts encapsulated as part of a contact block, the force required to ensure press-fit engagement with a printed circuit board may not cause movement of the contacts relative to the contact block. That is, the encapsulation may provide support for the contacts, preventing the contacts from moving relative to the contact block while the connector is firmly pressed onto the circuit board.

A problem may arise when press-fitting an electrical connector to a printed circuit board where the contacts are not encapsulated within a contact block during molding of the contact block. Contacts that are inserted into a contact block after the block is manufactured may move relative to the contact block when the electrical connector is press-fitted or otherwise connected to a printed circuit board. That is, as a force is applied on the electrical connector, pressing the connector onto the printed circuit board, the contacts may not fully engage with the printed circuit board and instead may move within the contact block, potentially causing damage to the contact block and electrical connector, and preventing a full connection with the printed circuit board.

SUMMARY OF THE INVENTION

An embodiment of the invention includes complementary contact and contact block designs that help prevent movement of a contact received in the contact block when an electrical connector is press-fit or otherwise connected to a printed circuit board or other substrate. A protrusion may be included on one or both beams of a dual beam contact, and a contact cavity may be formed in the contact block. The protrusion and the contact cavity may include complementary shapes such that the protrusion abuts a wall within the contact cavity, preventing the contact from moving relative to the contact block as the electrical connector is press-fit or otherwise connected to a printed circuit board. The protrusion and a wall of the contact cavity additionally may include other complementary shapes (e.g., a radius or angle shape) such that a length of the protrusion abuts the contact cavity wall, providing a longer load bearing surface. The longer load bearing surface may provide additional support to the connector, further preventing the contact from moving relative to the contact block when a connector is connected to a printed circuit board. The protrusion may include a retention surface, such as barbs or ribs, that bite into the contact block for added support.

DETAILED DESCRIPTION OF ILLUSTRATIVE EMBODIMENTS

Figure 1A:
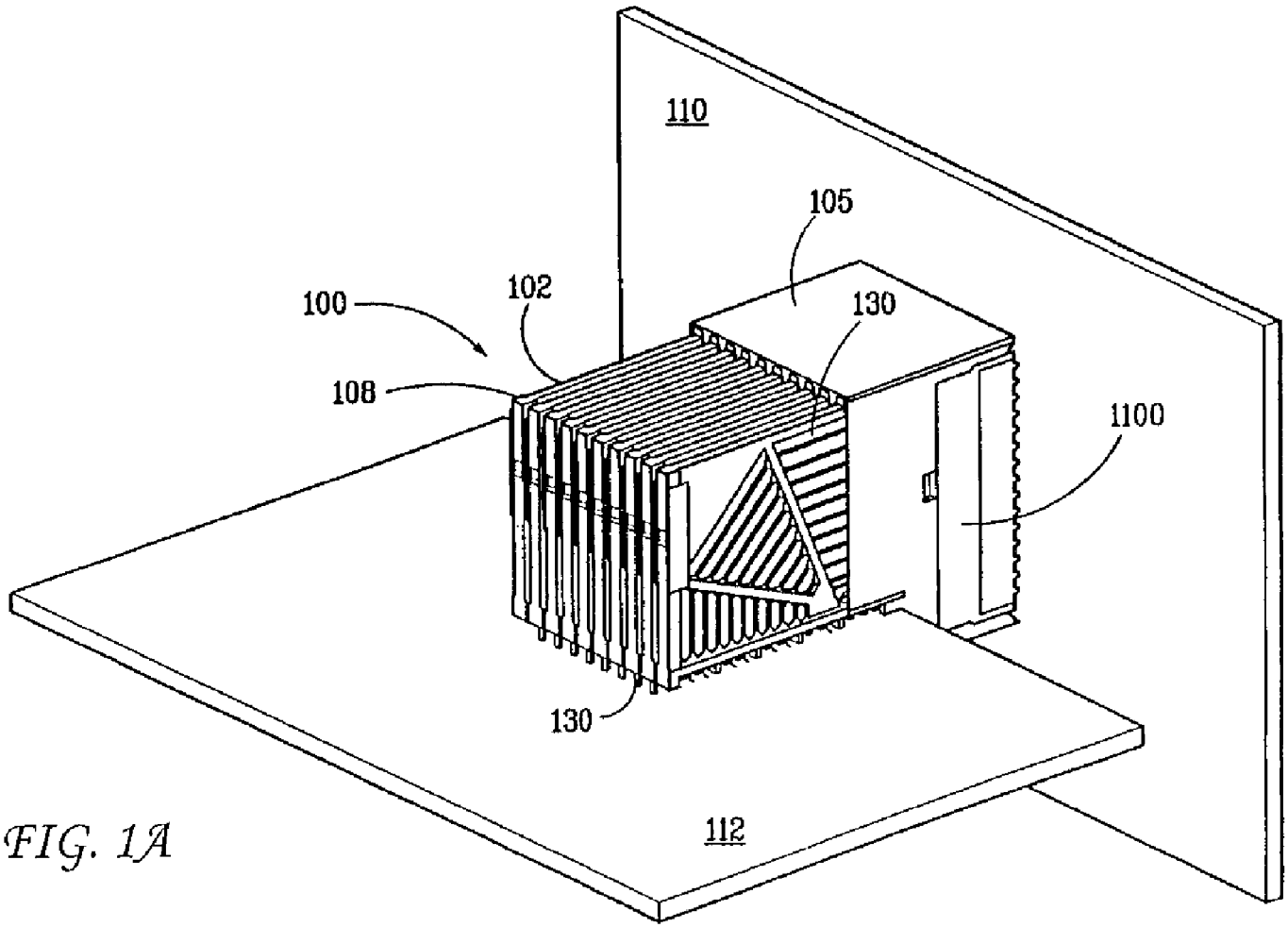
FIG. 1A is a perspective view of a backplane system having an exemplary right angle electrical connector in accordance with the invention.

FIG. 1A is a perspective view of a backplane system 110 having an exemplary right angle electrical connector 100 in accordance with an embodiment of the invention. However, the invention may take other forms such as a vertical or horizontal electrical connector. As shown in FIG. 1A, connector 100 comprises a plug connector 102 and receptacle connector 1100.

Plug connector 102 comprises housing 105 and a plurality of lead assemblies 108. The housing 105 is configured to contain and align the plurality of lead assemblies 108 such that an electrical connection suitable for signal communication is made between a first electrical device 112 and a second electrical device 110 via receptacle connector 1100. In one embodiment of the invention, electrical device 110 is a backplane and electrical device 112 is a daughter card. Electrical devices 110 and 112 may, however, be any electrical device without departing from the scope of the invention.

As shown, the connector 102 comprises a plurality of lead assemblies 108. Each lead assembly 108 comprises a column of contacts 130 therein as will be described below. Each lead assembly 108 comprises any number of contacts 130.

Figure 1B:
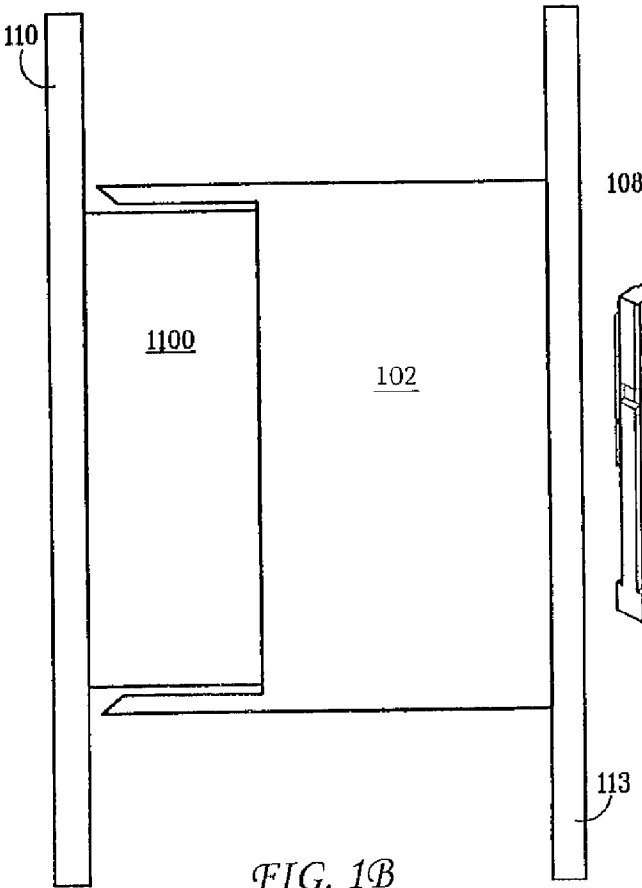
FIG. 1B is a simplified view of a board-to-board system having a vertical connector in accordance with the invention.

FIG. 1B is a board-to-board system similar to FIG. 1A except plug connector 102 is a vertical plug connector rather than a right angle plug connector. This embodiment makes electrical connection between two parallel electrical devices 110 and 113.

Figure 2:
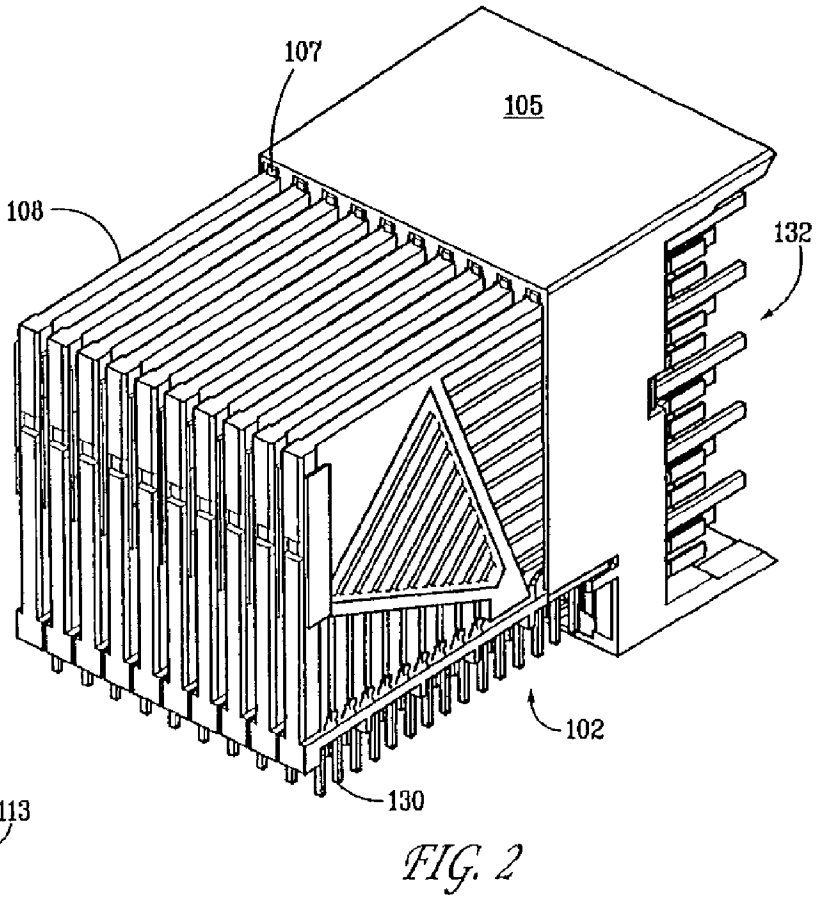
FIG. 2 is a perspective view of the plug connector of the backplane system shown in FIG. 1A.

FIG. 2 is a perspective view of the plug connector 102 of FIG. 1A shown without electrical devices 110 and 112 and receptacle connector 1100. As shown, slots 107 are formed in the housing 105 that contain and align the lead assemblies 108 therein. In one embodiment, the housing 105 is made of plastic, however, any suitable material may be used without departing from the scope of the invention. FIG. 2 also shows connection pins 130, 132. Connection pins 130 connect connector 102 to electrical device 112. Connection pins 132 electrically connect connector 102 to electrical device 110 via receptacle connector 1100. Connection pins 142 may be adapted to provide through-mount or surface-mount connections to an electrical device (not shown).

Figure 3:
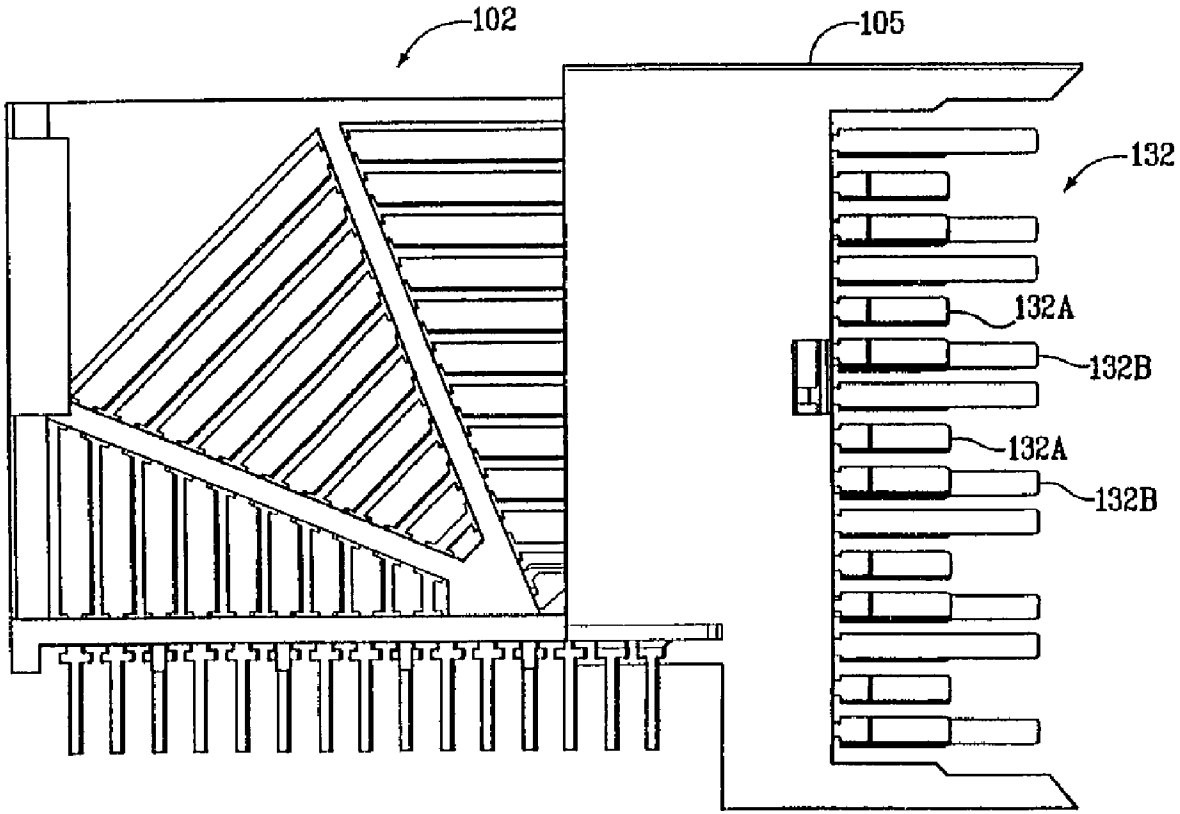
FIG. 3 is a side view of the plug connector of the backplane system shown in FIG. 1A.

FIG. 3 is a side view of plug connector 102 as shown in FIG. 2. As shown, in this configuration, the terminals (i.e., that portion of the contact that is mated with another connector or device) of the contacts 132 used to connect to receptacle connector 1100 vary in length, i.e. the terminals extend in varied lengths from the end of the housing 105. For example, as shown, ground terminals 132B extend a greater distance from housing 105 than signal terminals 132A. During the mating of the plug connector 102 to receptacle connector 1100, such configuration provides that the longer ground terminals 132B on plug 102 will mate with the corresponding ground terminals 1175B on the receptacle connector 1100 before the shorter signal terminals 132A mate with the corresponding signal terminals 1175A on the receptacle connector 1100. Such a configuration can be used to ensure that signal integrity is maintained when the plug 102 is mated with the receptacle connector 1100.

Figure 4:
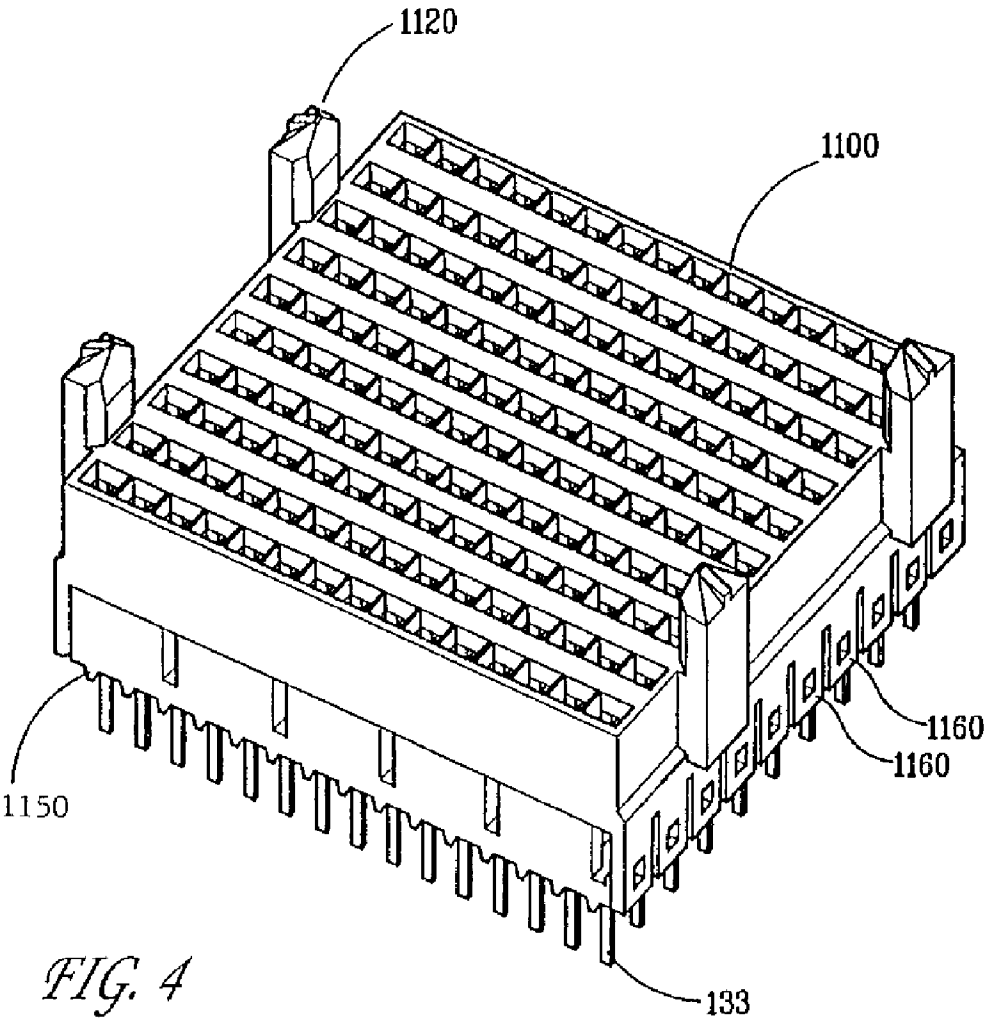
FIG. 4 is a perspective view of the receptacle connector of the backplane system shown in FIG. 1A.
Figure 5:
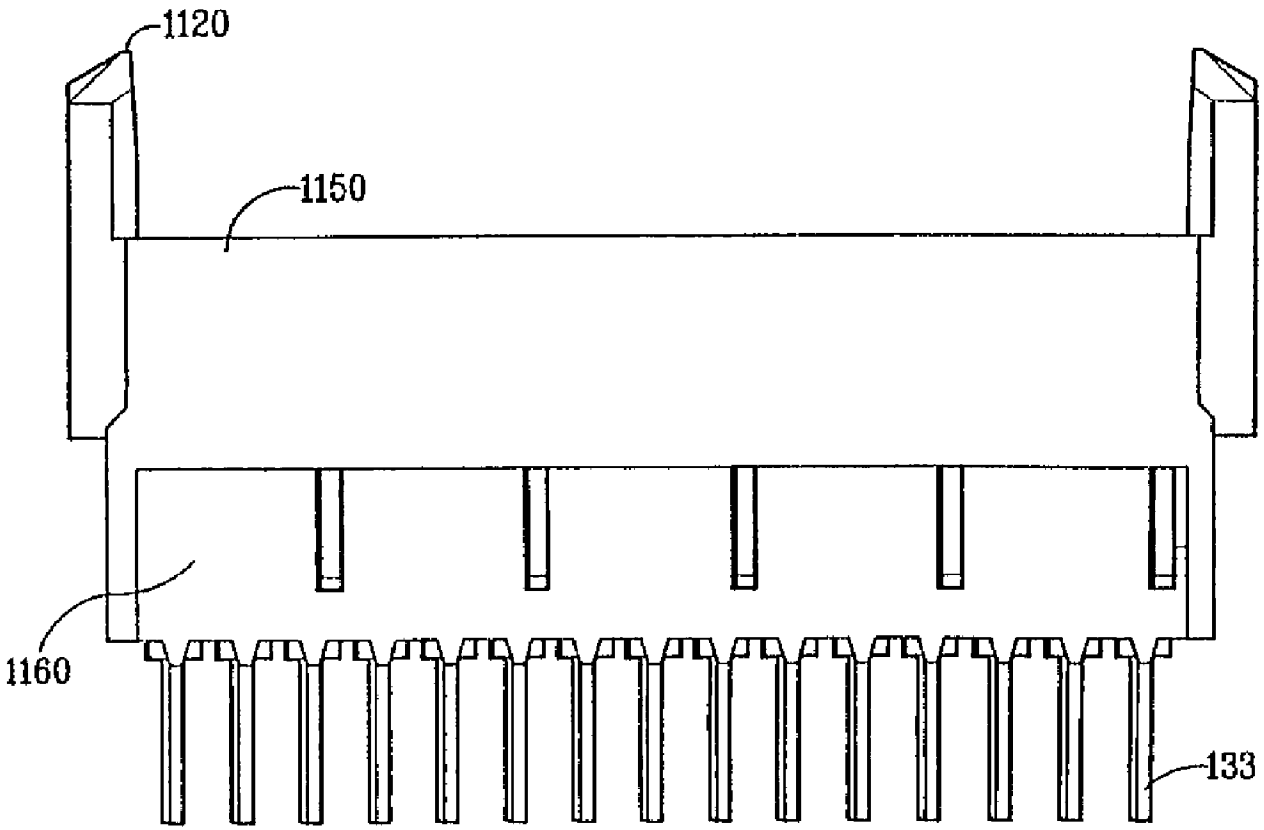
FIG. 5 is a side view of the receptacle connector shown in FIG. 4.

FIGS. 4 and 5 are a perspective view and side view, respectively, of the receptacle connector 1100 of the backplane system shown in FIG. 1A. In this manner, the receptacle connector 1100 may be mated with the plug connector 102 (as shown in FIG. 1A) and used to connect two electrical devices. Specifically, connection pins or contact terminals 133 (as shown in FIG. 1A) may be inserted into, for example, vias (not shown) on device 110 to electrically connect the plug connector 102 to device 110. In another embodiment of the invention, the connection pins 133 may be eye-of-the-needle pins for use in press-fit applications or a surface mount configuration.

Receptacle connector 1100 also includes alignment structures 1120 to aid in the alignment and insertion of the plug connector 102 into the receptacle connector 1100. Once inserted, structures 1120 also serve to secure the plug connector in the receptacle connector 1100. Such structures 1120 thereby resist any movement that may occur between the plug connector 102 and the receptacle connector 1100 that could result in mechanical breakage therebetween.

The receptacle connector 1100 includes a plurality of receptacle contact assemblies 1160 each containing a plurality of terminals 133 (only the tails of which are shown in FIG. 4) configured in rows. The terminals 133 provide the electrical pathway between the connector 100 and any mated electrical device (not shown).

Figure 6:
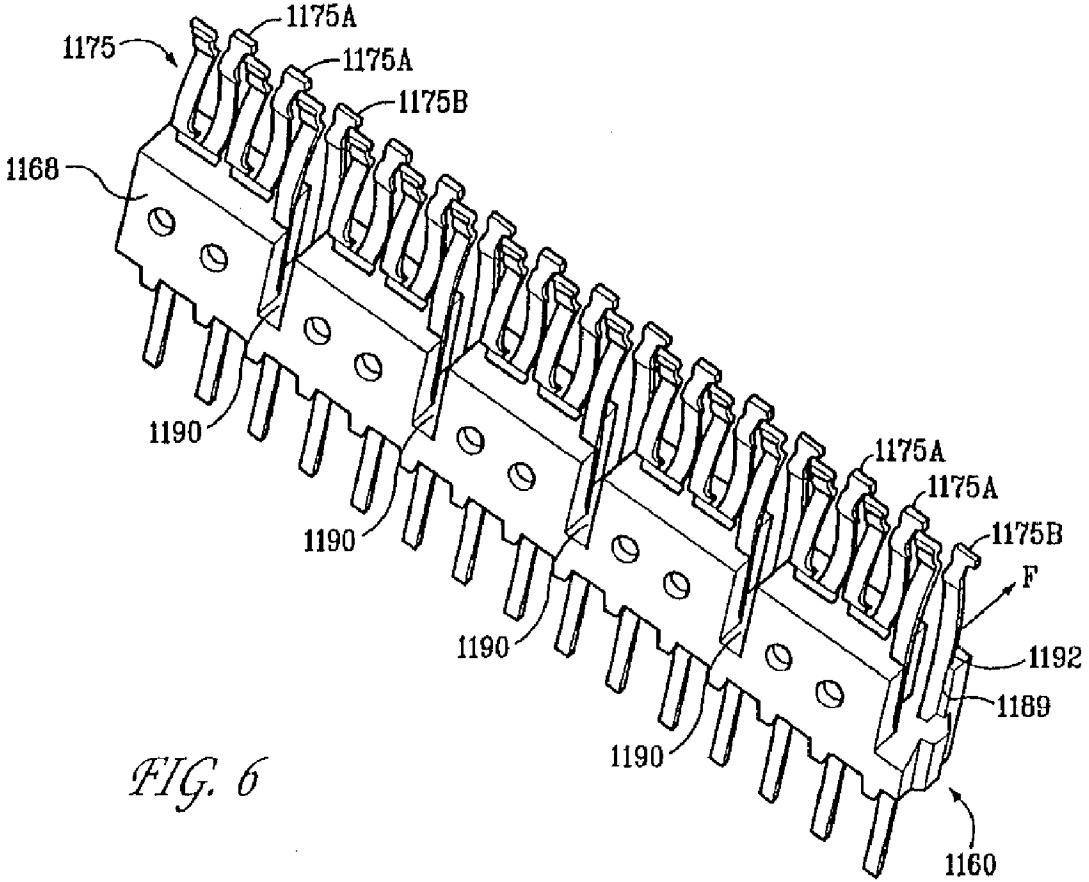
FIG. 6 provides a perspective view of an example contact assembly.

FIG. 6 provides a perspective view of a single receptacle contact assembly 1160 not contained in a receptacle housing 1150. As shown, the assembly 1160 includes a plurality of dual beam conductive contacts 1175 extending through a contact block 1168. The contact block is typically made from an insulating material. As shown in FIG. 6, and in one embodiment of the invention, contacts comprise ground contacts 1175B and signal contacts 1175A and are configured within the contact block 1168 in a signal-signal-ground configuration. To illustrate, starting from the left hand portion of the assembly 1160, the first and second contacts are signal contacts 1175A and the third contact is a ground terminal 1175B, such contact pattern continues along the length of the assembly 1160. Also as shown in FIG. 6, the assembly contains five sets of contacts, each set in a signal-signal-ground configuration.

As shown, the signal contacts 1175A have a dual beam configuration on one side of the contact block 1168 and a straight pin configuration on the other side of the contact block 1168. In another embodiment of the invention, the straight pin configuration of the signal contacts 1175A could be replaced with an eye-of-the-needle configuration for press fit applications or a surface mount configuration.

Also, as shown, the ground contacts 1175B have a dual beam configuration on one side of the contact block 1168 and a straight pin configuration on the other side of the contact block 1168. In another embodiment of the invention, the straight pin configuration of the ground contacts 1175B could be replaced with an eye-of-the-needle configuration for press fit applications or a surface mount configuration.

In accordance with one aspect of the invention, the contact block 1168 includes wells 1190. The wells 1190 may be wells or portions of the contact block 1168 that are cut out to allow the shorter signal contacts 132A of the plug connector 102 to mate with the signal contacts 1175A of the receptacle connector 1100 in such a way that the ground contacts 132B do not interfere with or prematurely bottom out on the contact block 1168. In one embodiment of the invention and as shown in FIG. 6, the wells 1190 are located between the dual beams of ground contacts 1175B.

In this manner, when the plug connector 102 is inserted the into receptacle connector 1100, the ground contacts 132B of the plug connector 102 are first to contact the dual beams of the ground contacts 1175B of the receptacle connector 1100. This occurs because the ground contacts 132B extend farther from the plug housing 105 than the signal contacts 132A, as described above. Thereafter, the ground contacts 132B extend between the dual beams of ground contacts 1175B and are inserted into wells 1190. The shorter signal contacts 132A then contact the signal contacts 1175A in the receptacle connector 1100. By providing wells 1190 between the dual beams of ground contacts 1175B, the shorter signal contacts 132A of the plug 102 can mate with the signal contacts 1175A of the receptacle connector 1100 in such a way that ground contacts 132B do not interfere with or prematurely bottom out on contact block 1168.

Further, by providing wells 1190 between the dual beams of the ground contact 1175B, the spring rate of the ground contact 1175B can be controlled to provide a desired spring rate. As addressed above, the spring rate of the ground contact 1175B is defined as the distance the contact moves (deflection) when force is applied thereto.

To illustrate, when a ground contact 132B is inserted into ground contact 1175B, the force of the insertion deflects ground contact 1175B in a direction indicated by arrow F as shown in FIG. 6. Typically, such direction is normal to the length of the ground terminal 1175B. The spring rate of ground contact 1175B is controlled by the fulcrum point 1192. In the embodiments shown in FIGS. 6 and 7, the fulcrum point 1192 is the uppermost point of well sidewall 1189 where the ground contact 1175B abuts the contact block 1168 and serves as the fulcrum when a contact such as the ground contact 132B is inserted into the dual beam ground contact 1175B. For example, in one embodiment, the tooling used to form the well can be adjusted independently of tooling used to form the fulcrum point on the sidewall. For example, each of these specifications can correspond to a customer specification.

Figure 7:
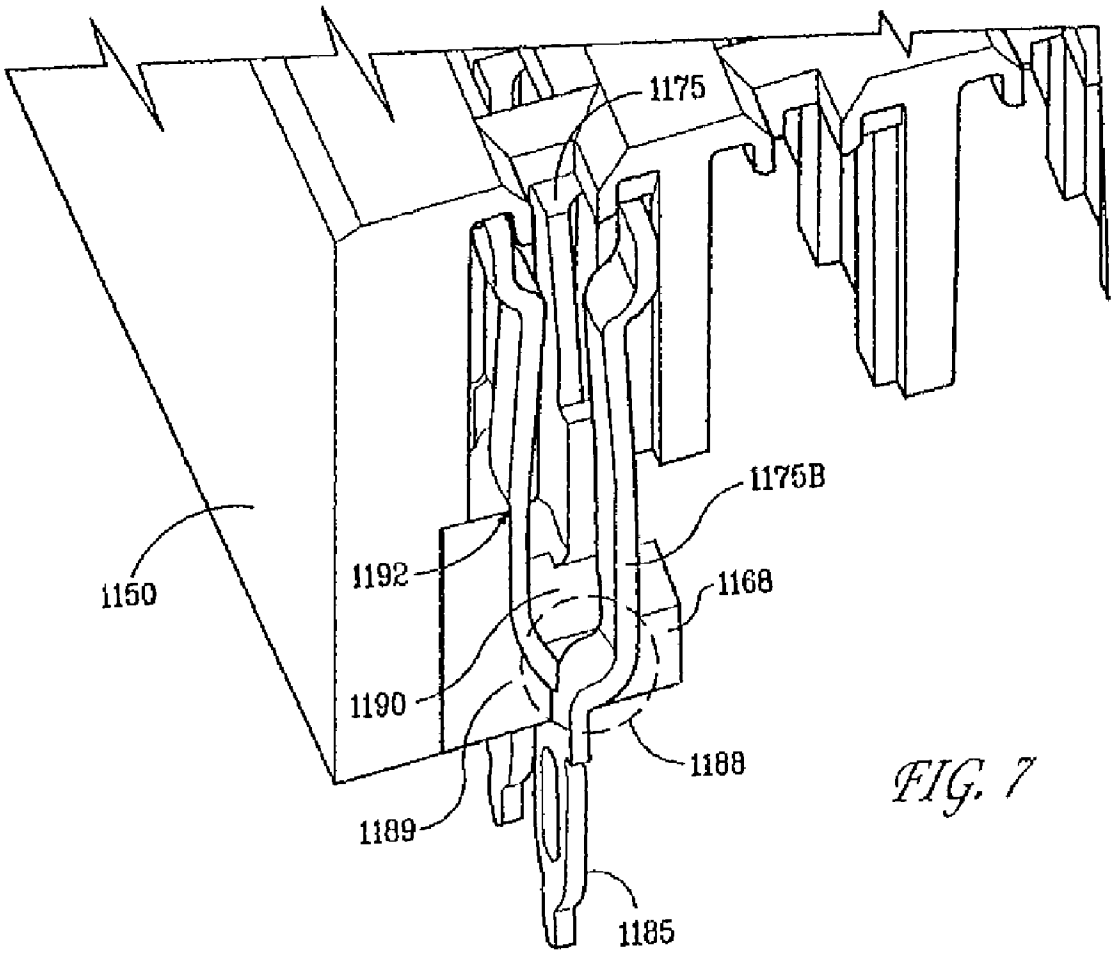
FIG. 7 provides a detailed view of a portion of an example receptacle.

FIG. 7 shows a detailed view of a portion of a receptacle contact assembly in accordance with the invention and contained in receptacle housing 1150. As shown, ground contacts 1175B are dual beam contacts for accepting a corresponding ground contact 132B from the plug connector 102. Ground contacts 1175B also have an eye-of-the-needle configuration for insertion into an electrical device (not shown) such as device 110 shown in FIG. 1A. The eye-of-the-needle configuration provides an oversized fit in a press-fit mounting application. However, as mentioned above, a surface mount configuration is possible.

Also shown in FIG. 7 is an encapsulated portion 1188 of ground contact 1175B. In this manner, the encapsulated portion 1188 is contained within contact block 1168. The encapsulated formed area may be a deformation in the contact terminal, such as an integral bend or kink in the terminal. The deformation may also be a separate barb attached to the terminal and contained in the contact block.

In one embodiment, the encapsulated portion is formed by using insert molding. In this manner, the contact terminals are stamp formed with a deformation portion positioned in a manner such that when the contact block 1168 is formed, the deformation area 1188 is encapsulated in the contact block 1168. Such a portion increase the mechanical integrity of the ground contact and reduces mechanical breakage when the receptacle is mated with either device such as the device 110 or the plug connector 102. The encapsulated formed area may vary without departing from the scope of the present invention.

Figure 8:
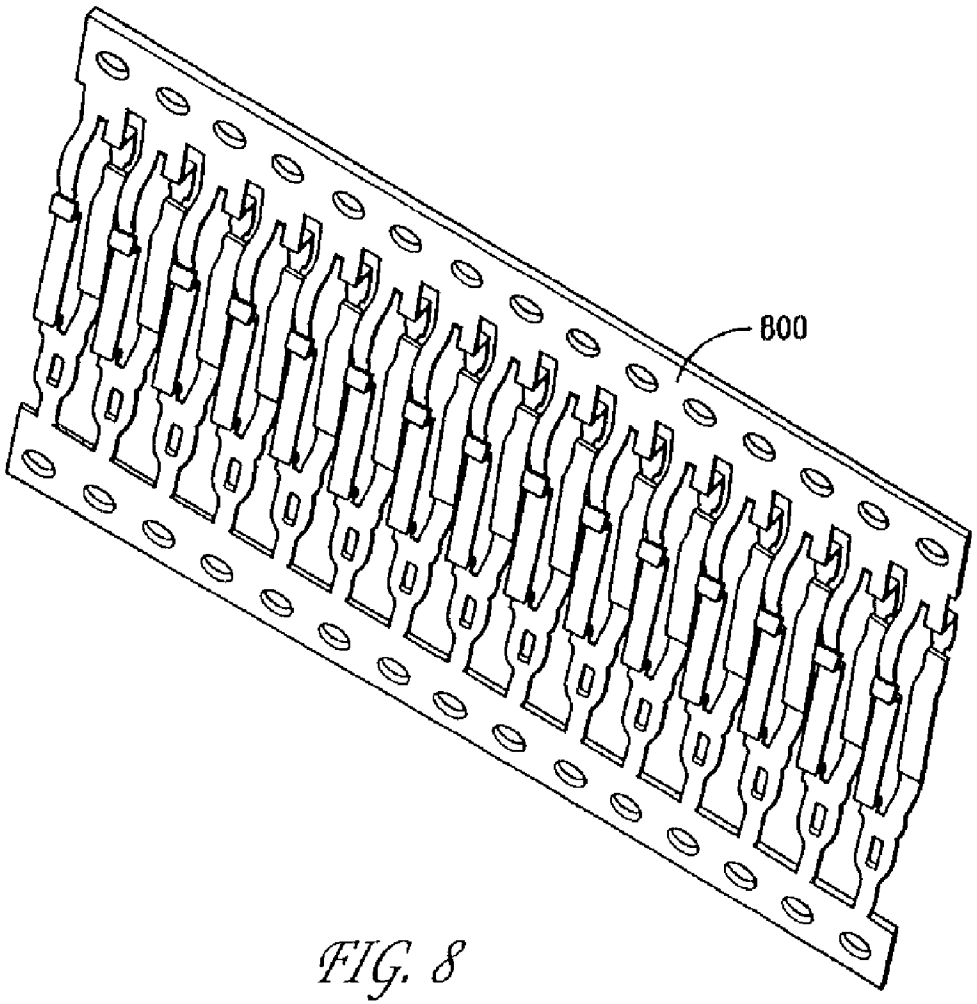
FIG. 8 is a perspective view of a row of stamped contact terminals that may be used to form a contact assembly in accordance with the invention.

In one embodiment of the invention, the contact block 1168 and wells 1190 are formed using insert molding. In this manner, a row of stamped contact terminals 800, as shown in FIG. 8, are inserted into a mold cavity and well pins (not shown) are used to contain and position the row of terminals in a precise location. The well pins are also used to form wells 1190, which will be described in more detail below.

Thereafter, once the contacts and well pins are positioned, molten plastic is injected into the mold cavity and allowed to form around the contacts and well pins. The molten plastic is then cooled and the well pins and the mold are removed. The result is a plastic contact block having wells 1190 with a desired position and depth and encapsulating the row of contacts.

It is also contemplated that varying the depth of wells 1190 in contact block 1168 provides for a desired contact wipe. Contact wipe is a deviation parameter used to allow for curvatures that may exist in an electrical device that results in non-simultaneous contact mating when connectors are mated. In this manner, increasing the depth of the well allows for greater contact wipe.

In one embodiment, a discrete set of wells are formed in the contact block using well pins. In this manner, the well pins are positioned in discrete positions in the center of the contact row and at a determined depth and position that will result in discrete wells within the contact block having a desired depth and position. Again, in one embodiment, the wells are positioned between the dual beams of ground contacts 1175B as shown in FIG. 6 and are adapted to receive ground contacts 132B of the plug connector 102.

Figure 9:
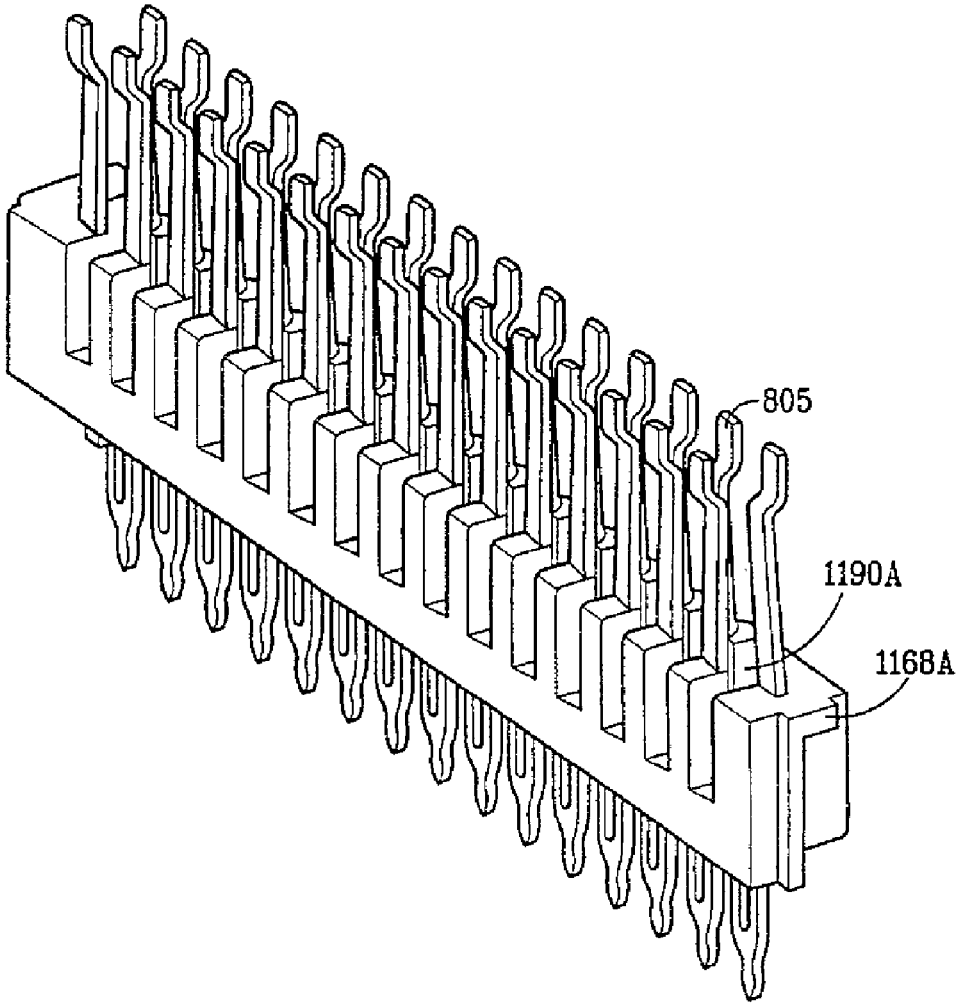
FIG. 9 is a perspective view of an alternative contact assembly.
Figure 10:
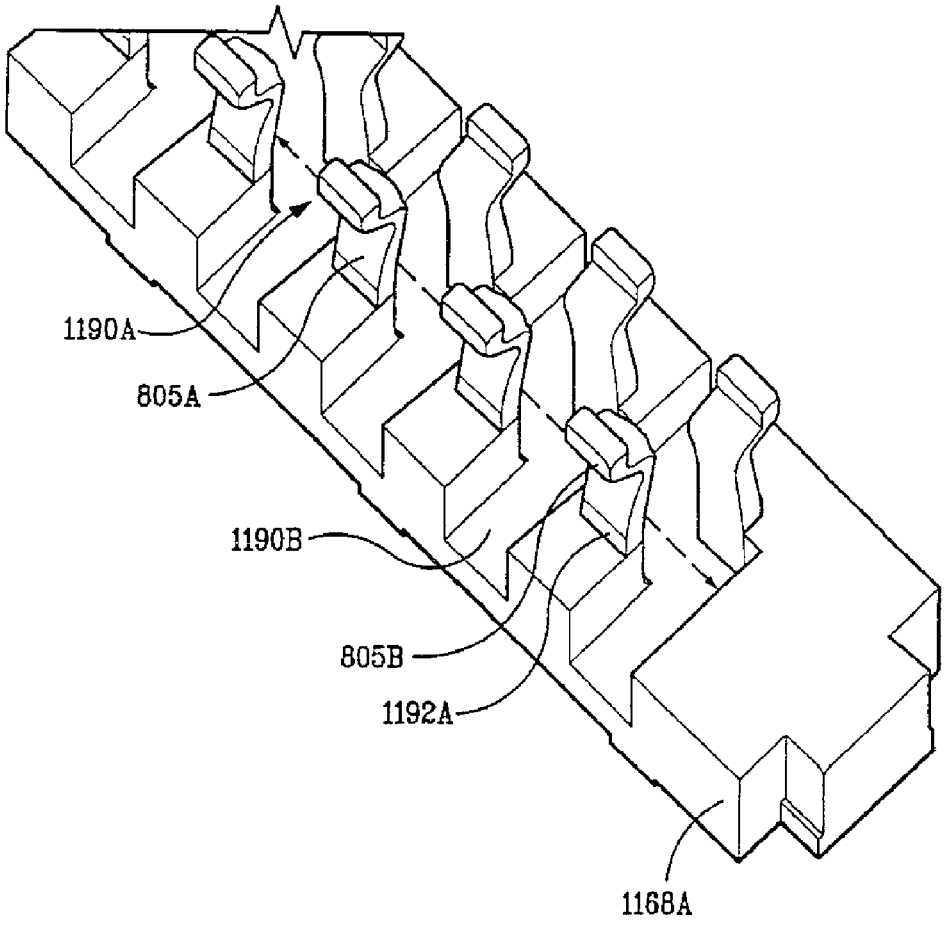
FIG. 10 is a top perspective view of the contact assembly of FIG. 9.

In another embodiment of the invention, the well pins are used to create a continuous open section through the center of the contact row of a determined depth and position that will result in one continuous well having a desired depth and position. Such an embodiment is shown in FIGS. 9 and 10. As shown in FIGS. 9 and 10, a single well 1190A extends along the center of contact block 1168A. Additionally, wells 1190B are formed between adjacent terminals 805A and 805B (FIG. 10).

Figure 11:
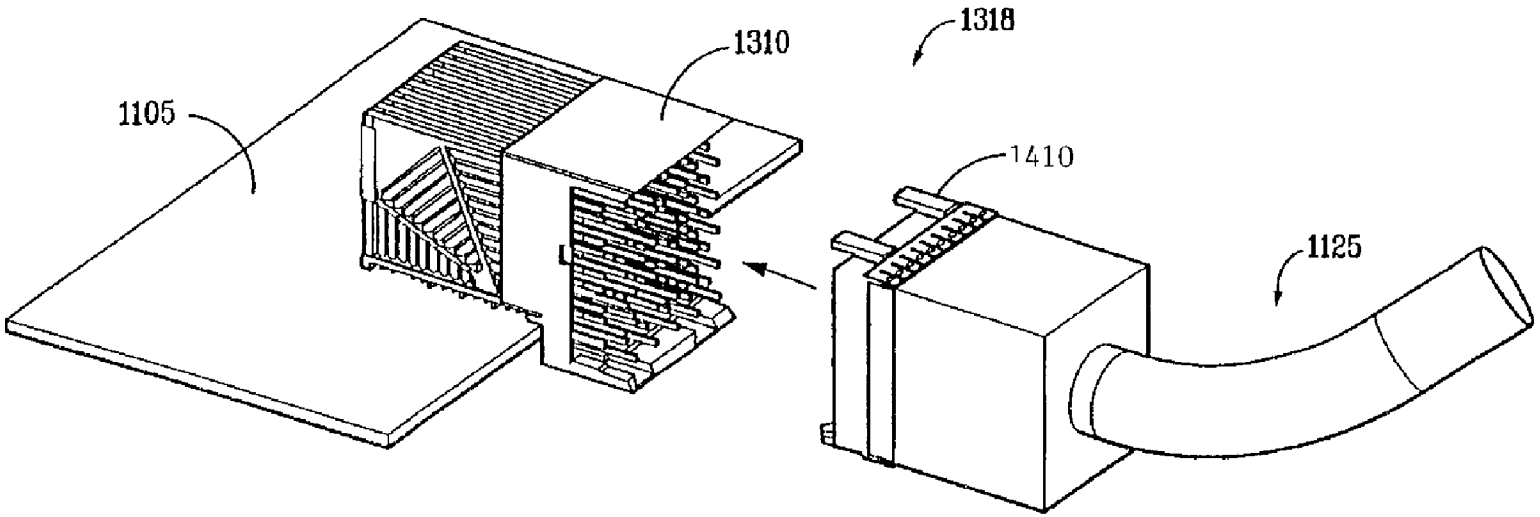
FIG. 11 is a perspective view of an alternative example connector.

FIG. 11 is a perspective view of a connector system 1318 in accordance with another embodiment of the invention. As shown, a plug connector 1310 and receptacle connector 1410 are used in combination to connect an electrical device, such as circuit board 1105 to a cable 1125. Specifically, when the plug connector 1310 is mated with the receptacle connector 1410, an electrical connection is established between the board 1305 and the cable 1125. The cable 1125 can then transmit signals to any electrical device (not shown) suitable for receiving such signals.

Figure 12:
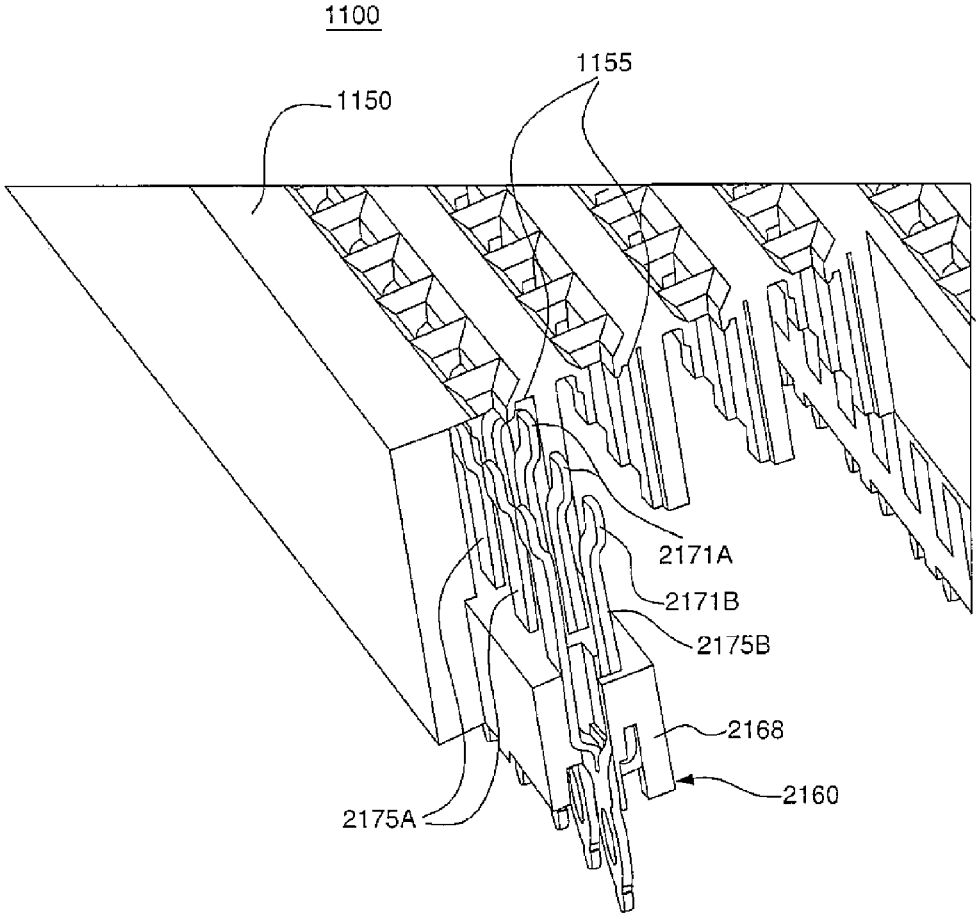
FIG. 12 is a partial cut-away view of an alternative example embodiment of a connector in accordance with the invention.

FIG. 12 is a partial cut-away view of an alternative example embodiment of a receptacle connector 1100, according to the invention. The receptacle connector 1100 may include a receptacle connector housing 1150 formed with one or more preloading cavities 1155. The preloading cavities 1155 may be formed in the receptacle connector housing 1150 in locations corresponding to contacts 2175A, 2175B of the receptacle contact assemblies 2160 when such assemblies 2160 are received in the receptacle connector housing 1150. The preloading cavities 1155 may be shaped such that a respective preloading tab 2171A, 2171B of a contact 2175A, 2175B may be received in the preloading cavities 1155. The contacts 2175A, 2175B are shown as eye-of-the-needle contacts for press-fit mating with a printed circuit board, though the preloading aspects of a receptacle connector such as the receptacle connector 1100 may be incorporated with other types of contacts as well. Additionally, the preloading aspects may be used in conjunction with receptacle contact assemblies such as the receptacle contact assembly 2160, where contacts 2175A, 2175B may be inserted into a contact block 2168 after the contact block 2168 is formed. Likewise, the preloading aspects may be used in conjunction with receptacle contact assemblies 1160 where the contacts 1175A, 1175B are molded as part of the contact block 1168, as described herein.

When a receptacle contact assembly 2160 is received in the housing 1150, the beams of the terminal contacts 2175A, 2175B may be deflected away from each other by a tool or other mechanism (not shown) to deflect the beams away from each other and insert the preloading tabs 2171A, 2171B into corresponding or complementary preloading cavities 1155. In this way, the preloading cavities 1155 may prevent the beams of the terminal contacts 2175A, 2175B from returning inwardly to their natural position, thus "loading" the contacts 2175A, 2175B. When contacts of a plug connector (not shown) are inserted into the terminal contacts 2175A, 2175B of the receptacle connector 1100, less of a force may be needed to fully mate the connectors. The preloading cavities 1155 hold the respective beams of the terminal contacts further 2175A, 2175B apart, allowing plug contacts to be inserted further into the terminal contacts 2175A, 2175B before pressing against and forcing apart the beams of the terminal contacts 2175A, 2175B. Thus, because the preloading cavities 1155 hold the preloading tabs 2171A, 2171B in a deflected position, the beams of the contacts 2175A, 2175B are needed to deflect a smaller distance during mating with respective plug contacts than if the contacts 2175A, 2175B were not preloaded.

Figure 13:
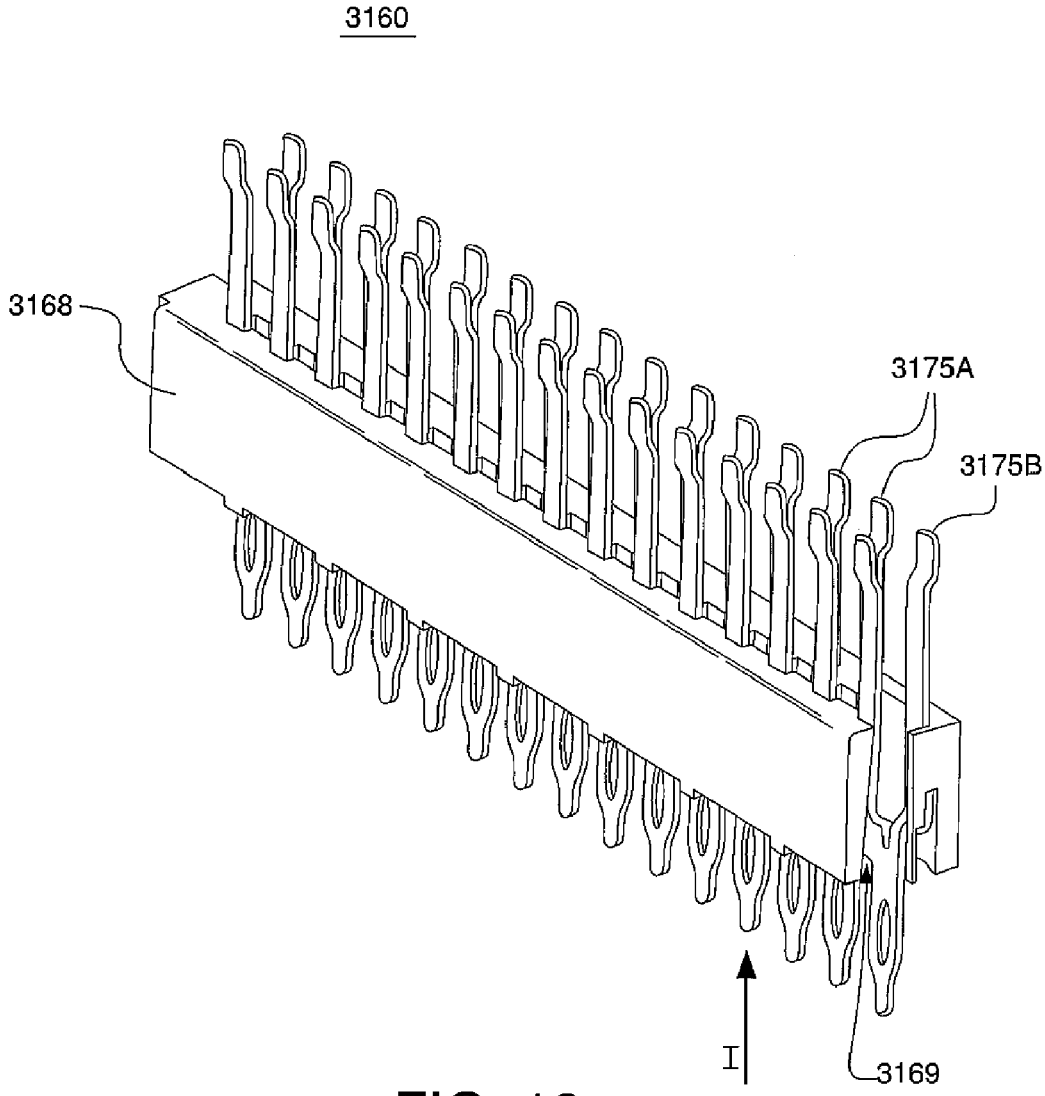
FIG. 13 is a partial cut-away view of an alternative embodiment of a contact assembly in accordance with the invention.
Figure 14A:
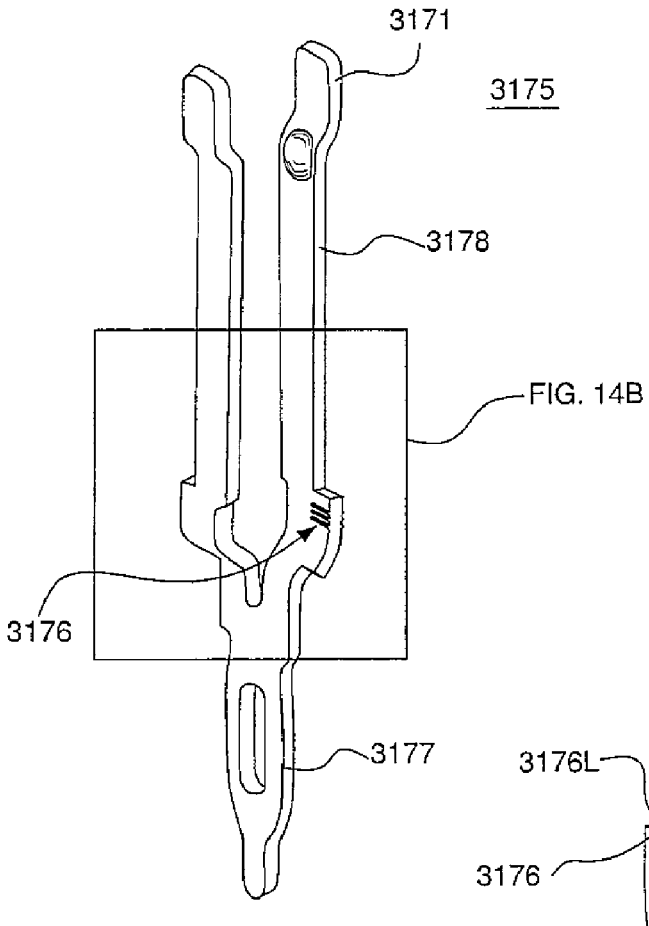
FIGS. 14A and 14B depict, respectively, a perspective view and a partial perspective view of an example embodiment of an eye-of-the-needle electrical contact in accordance with the invention.
Figure 14B:
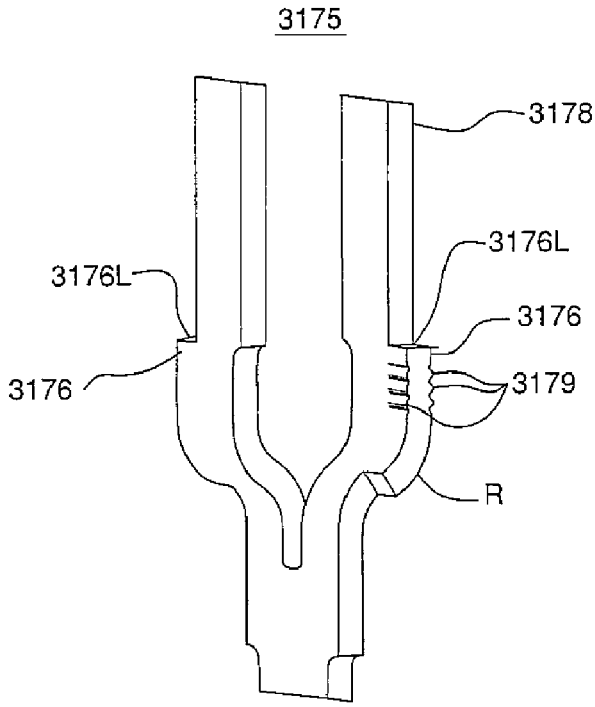
Figure 15:
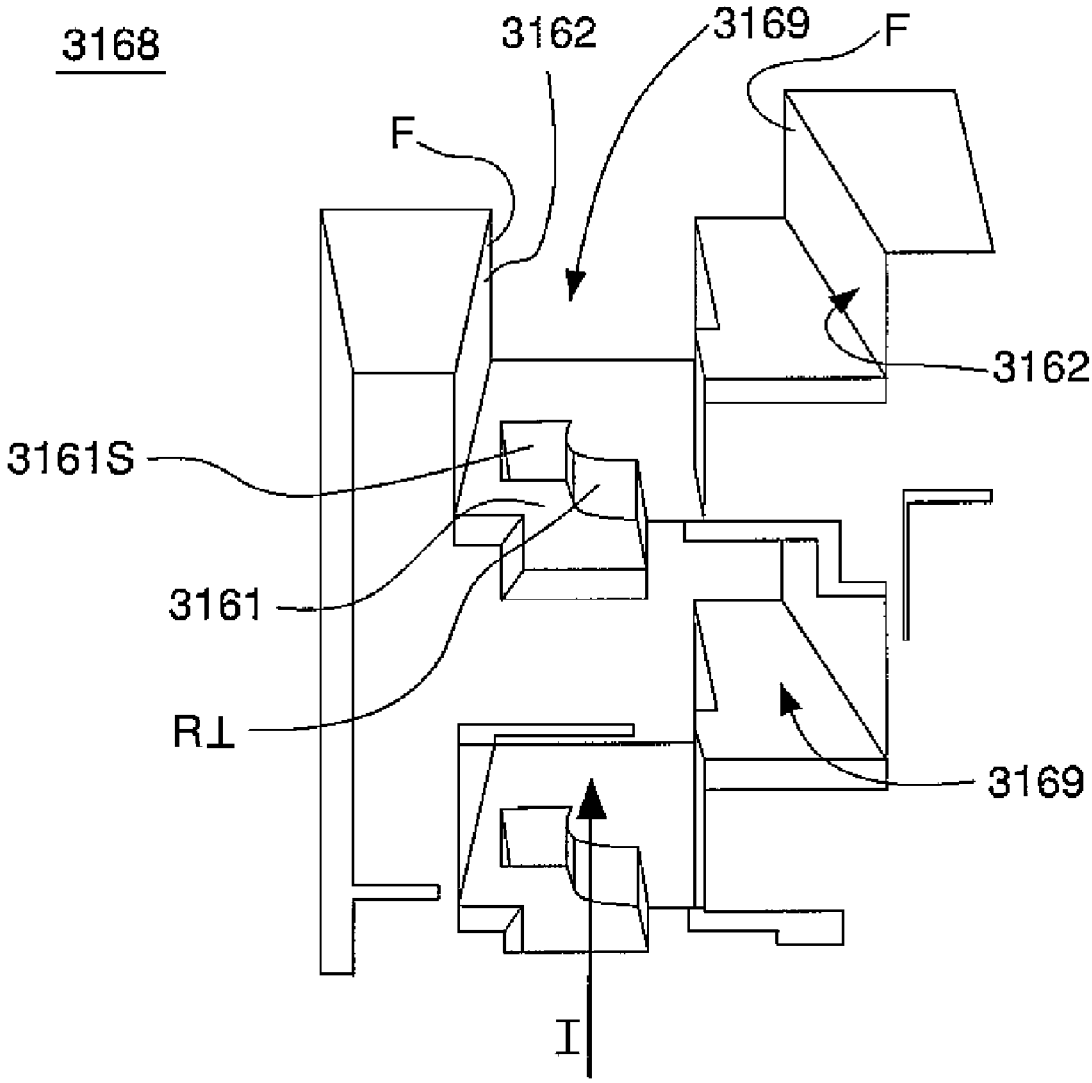
FIG. 15 depicts a partial bottom view of a contact block in accordance with the invention.

FIG. 13 is a partial cut-away view of an alternative embodiment of a receptacle contact assembly 3160, according to the invention. FIGS. 14A and 14B depict, respectively, a perspective view and a partial perspective view of an example embodiment of an eye-of-the-needle electrical contact 3175 for insertion into a contact block after the contact block is manufactured. FIG. 15 depicts a partial bottom view of a contact block 3168 for receiving the electrical contact 3175, according to the invention. The receptacle contact assembly 3160 may be received in a receptacle connector housing such as the receptacle connector housing 1150 described herein to form a receptacle connector 1100. The receptacle contact assembly 3160 may include eye-of-the-needle signal and ground contacts 3175A, 3175B. The contacts 3175A, 3175B may be used in a press-fit connection with a printed circuit board (not shown). Of course, alternative embodiments of the invention may include other types of contacts as well.

The receptacle contact assembly 3160 may be assembled by a single stitch or mass-insertion process in which contacts 3175A, 3175B are inserted into molded contact cavities 3169 of the contact block 3168. The molded contact cavities 3169 may best be seen in FIG. 15. That is, receptacle connectors according to the invention may include either receptacle assemblies in which the contacts 1175A, 1175B are molded as part of the contact block 1168 of the receptacle contact assembly 1160 or in which the contacts 3175A, 3175B are inserted into contact cavities 3169 of the contact block 3168 after the contact block 3168 is manufactured. After the contacts 3175A, 3175B are inserted into or received in the contact block 3168, the receptacle assembly 3160 may be inserted into or received in a receptacle connector housing 1150 to produce a receptacle connector 1100.

Because the contacts 3175A, 3175B may be inserted after the contact block 3168 is manufactured, the contacts 3175A, 3175B that are assembled with the connector 1100 may be chosen after the contact block 3168 is manufactured. For example, contacts 3175A, 3175B may be inserted into the contact block 3168 or, alternatively, contacts having a shorter or a longer dual beam portion may be inserted into the contact block 3168. This provides an advantage over the insert molded lead assemblies, where contact length selection is typically made prior to encapsulating the contact 1175A, 1175B in the contact block 1168.

The contact assembly 3160 may include eye-of-the-needle contacts for press-fit connection to a printed circuit board (not shown) The contacts 3175A, 3175B and the contact cavities 3169 of the contact block 3168 may include complementary shapes to prevent damage to the receptacle connector 1100 or undesired movement of the contacts 3175A, 3175B when a force necessary for press-fit connection is applied to the connector 1100. Of course, the complementary shapes described herein may be used in other receptacle connectors 1100 that are surface mounted or otherwise electrically connected to a printed circuit board, but the shapes herein described are well-suited in press-fit application where a larger force may be applied than when using, for example, some surface mounting techniques.

The electrical contact 3175 shown in FIGS. 14A and 14B may be either a signal contact 3175A or a ground contact 3175B. The contact 3175 may include a protrusion 3176 extending in a direction perpendicular to a direction in which the contact 3175 extends. The protrusion 3176 is shown as the same thickness as the contact 3175, though it is understood that the protrusion may be include a thickness that is less or more than that of the contact 3175. The protrusion 3176 may correspond with a complementary indentation 3161 formed or molded as part of the contact cavity 3169 of the contact block 3168. As shown in FIG. 15, the contact block 3168 may be adapted to receive contacts such as the contact 3175 in a direction indicated by the insertion arrow I. That is, the contact 3175 may be inserted into the contact block 3168 from a direction away from a printed circuit board to which the contact 3175 may be electrically connected after the receptacle connector 1100 is assembled.

As the contact 3175 is inserted into the contact block 3168 in the direction of the arrow I, the protrusion 3176 may be received in a complementary indentation 3161 of the contact cavity 3169. The indentation 3161 may include a stop 3161S against which a leading surface 3176L of the protrusion 3176 abuts, preventing the contact 3175 from moving further in the insertion direction indicated by the insertion arrow I once the contact 3175 is fully received in the contact block 3168. The protrusion 3176 may perform a load-bearing or load-absorbing function when the electrical connector 3175 is connected by press-fit or other engagement with a printed circuit board. As a force is applied on a receptacle connector 1100 against a substrate to press-fit or connect the contacts 3175 to the printed circuit board, the protrusions 3176 may bear or absorb the corresponding normal force, thus enabling the contacts 3175 to be press fit without moving within the receptacle connector 1100 (e.g., relative to the contact block 3168 or connector 1100) in an undesirable manner. By preventing the contacts 3175 from undesirable movement, the protrusions 3175 may help ensure a full press-fit or other connection of all contacts 3175 with a printed circuit board.

The protrusion 3176 may be in a location along a length of the contact 3175 such that it will correspond with the complementary contact cavity 3169 in the contact block 3168. For example, as shown in FIGS. 14A and 14B, the protrusion 3176 may be located where the contact 3175 includes a radius R (i.e., an arc shape) that acts as a transition between the eye-of-the-needle portion 3177 of the contact 3175 and the dual beam portion 3178 of the contact 3175. Positioning the protrusion 3176 at the radius R of the contact 3175 may provide added load-bearing functionality of the protrusion 3176, as the radius R allows the length of the protrusion to abut a corresponding radius R1 of a wall within the indentation 3161. Of course, those skilled in the art will recognize that other shapes or angles may be used to provide improved load-bearing functionality in addition to the radii R, R1. It should also be understood that, while the protrusion 3176 is shown on each beam 3178 of the dual beam contact 3175, in alternative embodiments, a protrusion may extend from only one beam 3178 of the dual beam contact 3175.

Additionally, the contact 3175 may be devoid of protrusions 3176. That is, the radius R on the contact 3175 may help perform a load bearing function as herein described when press-fitting or connecting the contact 3175 to a printed circuit board. While the protrusions 3176 may increase such load-bearing functionality, use of the radius R in conjunction with the shape of the contact cavity 3169 may enable the contact 3175 to be wedged within the contact cavity 3169. The wedging of the contact 3175 within the contact cavity 3169 at the radius R may prevent movement of the contact 3175 in the direction of insertion as shown by arrow I when press-fitting or connecting the contact 3175 to a printed circuit board.

To further increase its load-bearing functionality, the protrusion 3176 may include retention features 3179 on one or both of its sides that enable the protrusion 3176 to bite into the contact block 3168 upon insertion into the contact block 3168 and during mating of the receptacle connector 1100 with a printed circuit board. The retention features 3179 may include barbs, ribs, or other gripping surfaces to provide this added functionality.

The contact cavity 3169 formed in the contact block 3168 may include tapered sidewalls 3162 in addition to the indentation 3161. The tapered sidewalls 3162 may perform a lead-in function as the contact 3175 is inserted into the contact block 3168. The tapered sidewalls 3162 may help prevent damage to the contact 3175 as it is inserted into the contact block 3168 because the tapered sidewalls 3162 may obviate a need for compressing the beams 3178 of the dual beam contact 3175 towards each other to ensure that the contact 3175 can be received in the contact cavity 3169. The opening offered by the contact cavity 3169 in the contact block 3168 may be large enough to receive the contact 3175 without such compression.

Additionally, as the contact 3175 is inserted into the contact block 3168, the tapered sidewalls 3162 perform a compression function, forcing the beams 3178 of the contact 3175 toward each other as the contact 3175 is continually inserted into the contact block 3168. The contact 3175 may include a preloading tab 3171 similar to that described herein with regard to the contact 2175 of FIG. 12 and as shown herein with regard to the contacts 1175A, 1175B. The preloading tab 3178 may abut the sidewall 3162 as the contact 3175 is inserted into the contact block 3168 and, when the preloading tab 3171 passes the point F on the contact block 3168, the beams 3178 of the contact 3175 may move away from each other such that they each abut the sidewall of the contact cavity 3169 at point F.

When the contact 3175 is fully received in the contact block 3168, the point F may act as a fulcrum point of the beam 3178 of the contact 3175 extending from the point F to a preloading cavity such as the preloading cavity 1155 of the receptacle connector housing 1150, as described with regard to FIG. 12 and shown in other figures herein.

It is to be understood that the foregoing illustrative embodiments have been provided merely for the purpose of explanation and are in no way to be construed as limiting of the invention. Words which have been used herein are words of description and illustration, rather than words of limitation. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

What is claimed:

1. An electrical connector, comprising:

a contact block comprising a contact cavity, wherein the contact cavity comprises a sidewall and a stop; and a dual beam electrical contact inserted into the contact cavity of the contact block in a direction of insertion, wherein each beam of the dual beam contact extends in a first direction, wherein at least one beam comprises a protrusion extending in a direction perpendicular to the first direction, the protrusion abutting the stop to help prevent movement of the contact in the direction of insertion, and wherein the contact block includes a well disposed between the beams of the dual beam electrical contact.

2. The electrical connector of claim 1, wherein a portion of at least one beam comprises a first shape and a portion of the sidewall of the contact cavity comprises a second shape, wherein the first and second shapes are complementary and the portion of the at least one beam abuts the portion of the sidewall to help prevent movement of the contact in the direction of insertion.

3. The electrical connector of claim 2, wherein each of the first and second shapes is a radius.

4. The electrical connector of claim 2, wherein the protrusion comprises the first shape.

5. The electrical connector of claim 1, wherein the contact is adapted for press-fit connection to a substrate.

6. The electrical connector of claim 1, wherein the contact further comprises a retention feature that bites the contact block to help prevent movement of the contact in the direction of insertion.

7. The electrical connector of claim 6, wherein the retention feature comprises a barb.

8. The electrical connector of claim 1, wherein the sidewall is tapered such that the contact cavity decreases in size in the direction of insertion.

9. The electrical connector of claim 1, further comprising:

a housing, wherein the contact block and the electrical contact are received in the housing, wherein the housing comprises a preloading cavity, wherein the contact comprises a preloading tab, and wherein the preloading tab is received in the preloading cavity.

10. An electrical connector, comprising:

a contact block comprising a contact cavity having a sidewall, the sidewall defining a first shape in a portion of the contact cavity;

a dual beam electrical contact inserted into the contact cavity of the contact block in a direction of insertion, wherein a portion of at least one beam of the dual beam contact has a second shape, wherein the first and second shapes are complementary, wherein the portion of the at least one beam abuts the sidewall in the portion of the contact cavity to help prevent movement of the contact in the direction of insertion, wherein the contact cavity comprises an opening for receiving the contact without deflecting the beams of the dual beam contact toward each other, and wherein the sidewall is adapted to deflect the beams of the dual beam contact toward each other as the contact is inserted into the contact cavity.

11. The electrical connector of claim 10, wherein each of the first and second shapes is a radius.

12. The electrical connector of claim 10, wherein the contact further comprises a rib that bites into the contact block to help prevent movement of the contact in the direction of insertion.

13. An electrical connector, comprising:

a receptacle housing comprising a preloading cavity;

a contact block received in the receptacle housing; and a dual beam electrical contact comprising a preloading tab, wherein the preloading tab is received in the preloading cavity, wherein the contact block includes a well disposed between the beams of the dual beam electrical contact, wherein the contact block further includes a contact cavity having a stop, and wherein the contact is received in the contact cavity after being inserted into the contact cavity in a direction of insertion.

14. The electrical connector of claim 13, wherein the contact has an encapsulated formed area within the contact block.

15. The electrical connector of claim 13, wherein each beam of the dual beam contact extends in a first direction and wherein at least one beam comprises a protrusion extending in a direction perpendicular to the first direction, the protrusion abutting the stop to help prevent movement of the contact in the direction of insertion.

16. The electrical connector of claim 15, wherein the protrusion comprises a retention feature that bites the contact block to help prevent movement of the contact in the direction of insertion.

17. The electrical connector of claim 15, wherein the protrusion comprises a thickness different from the thickness of the at least one beam.

18. An electrical connector, comprising:

a contact block comprising a contact cavity, wherein the contact cavity comprises a sidewall and a stop; and a dual beam electrical contact inserted into the contact cavity of the contact block in a direction of insertion, wherein each beam of the dual beam contact extends in a first direction, wherein at least one beam comprises a protrusion extending in a direction perpendicular to the first direction, the protrusion abutting the stop to help prevent movement of the contact in the direction of insertion, wherein a portion of at least one beam comprises a first shape and a portion of the sidewall of the contact cavity comprises a second shape, and wherein the first and second shapes are complementary and the portion of the at least one beam abuts the portion of the sidewall to help prevent movement of the contact in the direction of insertion.

19. The electrical connector of claim 18, wherein each of the first and second shapes is a radius.

20. The electrical connector of claim 18, wherein the protrusion comprises the first shape.

21. The electrical connector of claim 18, wherein the contact is adapted for press-fit connection to a substrate.

22. The electrical connector of claim 18, wherein the contact further comprises a retention feature that bites the contact block to help prevent movement of the contact in the direction of insertion.

23. The electrical connector of claim 22, wherein the retention feature comprises a barb.

24. The electrical connector of claim 18, wherein the sidewall is tapered such that the contact cavity decreases in size in the direction of insertion.

25. The electrical connector of claim 18, further comprising:

a housing, wherein the contact block and the electrical contact are received in the housing, wherein the housing comprises a preloading cavity, wherein the contact comprises a preloading tab, and wherein the preloading tab is received in the preloading cavity.

26. An electrical connector, comprising:

a contact block comprising a contact cavity, wherein the contact cavity comprises a sidewall and a stop; and a dual beam electrical contact inserted into the contact cavity of the contact block in a direction of insertion, wherein each beam of the dual beam contact extends in a first direction, wherein at least one beam comprises a protrusion extending in a direction perpendicular to the first direction, the protrusion abutting the stop to help prevent movement of the contact in the direction of insertion, and wherein the sidewall is tapered such that the contact cavity decreases in size in the direction of insertion.

27. The electrical connector of claim 26, further comprising:

a housing, wherein the contact block and the electrical contact are received in the housing, wherein the housing comprises a preloading cavity, wherein the contact comprises a preloading tab, and wherein the preloading tab is received in the preloading cavity.

28. The electrical connector of claim 26, wherein a portion of at least one beam comprises a first shape and a portion of the sidewall of the contact cavity comprises a second shape, wherein the first and second shapes are complementary and the portion of the at least one beam abuts the portion of the sidewall to help prevent movement of the contact in the direction of insertion, and wherein each of the first and second shapes is a radius.

29. The electrical connector of claim 26, wherein a portion of at least one beam comprises a first shape and a portion of the sidewall of the contact cavity comprises a second shape, wherein the first and second shapes are complementary and the portion of the at least one beam abuts the portion of the sidewall to help prevent movement of the contact in the direction of insertion, and wherein the protrusion comprises the first shape.

30. The electrical connector of claim 26, wherein the contact is adapted for press-fit connection to a substrate.

31. The electrical connector of claim 26, wherein the contact further comprises a retention feature that bites the contact block to help prevent movement of the contact in the direction of insertion.

32. The electrical connector of claim 31, wherein the retention feature comprises a barb.

33. An electrical connector, comprising:

a contact block comprising a contact cavity, wherein the contact cavity comprises a sidewall and a stop;

a dual beam electrical contact inserted into the contact cavity of the contact block in a direction of insertion, wherein each beam of the dual beam contact extends in a first direction, wherein at least one beam comprises a protrusion extending in a direction perpendicular to the first direction, the protrusion abutting the stop to help prevent movement of the contact in the direction of insertion, and wherein the contact block includes a well disposed between the beams of the dual beam electrical contact; and a housing, wherein the contact block and the electrical contact are received in the housing, wherein the housing comprises a preloading cavity, wherein the contact comprises a preloading tab, and wherein the preloading tab is received in the preloading cavity.

34. The electrical connector of claim 33, wherein a portion of at least one beam comprises a first shape and a portion of the sidewall of the contact cavity comprises a second shape, wherein the first and second shapes are complementary and the portion of the at least one beam abuts the portion of the sidewall to help prevent movement of the contact in the direction of insertion, and wherein each of the first and second shapes is a radius.

35. The electrical connector of claim 33, wherein a portion of at least one beam comprises a first shape and a portion of the sidewall of the contact cavity comprises a second shape, wherein the first and second shapes are complementary and the portion of the at least one beam abuts the portion of the sidewall to help prevent movement of the contact in the direction of insertion, and wherein the protrusion comprises the first shape.

36. The electrical connector of claim 33, wherein the contact is adapted for press-fit connection to a substrate.

37. The electrical connector of claim 33, wherein the contact further comprises a retention feature that bites the contact block to help prevent movement of the contact in the direction of insertion.

38. The electrical connector of claim 37, wherein the retention feature comprises a barb.

* * * * *